US005762310A

United States Patent [19]

Schill

[11] Patent Number: 5,762,310

[45] Date of Patent: Jun. 9, 1998

[54] INFANT SEAT SUPPORT WITH A RESTING SURFACE HAVING AN ADJUSTABLE HEIGHT

[76] Inventor: Francine E. Schill, R.R. #1 Box 334-A1, South New Berlin, N.Y. 13843

[21] Appl. No.: 599,035

[22] Filed: Feb. 9, 1996

[51] Int. Cl.[6] ..... F16M 11/24

[52] U.S. Cl. ..... 248/432; 248/164; 248/297.31

[58] Field of Search ..... 248/164, 188.6, 248/221.11, 223.41, 295.11, 297.31, 440.1, 432; 403/348, 349, 353

[56] References Cited

U.S. PATENT DOCUMENTS

| | | | |
|---|---|---|---|
| 3,071,400 | 1/1963 | Bellock | 248/222.41 |
| 3,839,754 | 10/1974 | Hooper | 248/164 |
| 4,544,203 | 10/1985 | Younger et al. | 403/348 |
| 4,705,247 | 11/1987 | Delmerico | 248/164 |
| 4,714,224 | 12/1987 | Calmes | 248/164 |
| 4,773,788 | 9/1988 | Ruhl | 403/348 |
| 5,094,148 | 3/1992 | Haber et al. | 423/348 |
| 5,143,331 | 9/1992 | Robert | 248/222.41 |
| 5,190,254 | 3/1993 | Maguire | 248/164 |
| 5,420,762 | 5/1995 | Lewis | 248/222.41 |
| 5,496,094 | 3/1996 | Schwartzkopf et al. | 248/164 |

FOREIGN PATENT DOCUMENTS

| | | | |
|---|---|---|---|
| 0941688 | 4/1956 | Germany | 248/222.41 |
| 2000041 | 1/1977 | Japan | 248/297.31 |
| 0134752 | 3/1952 | Sweden | 248/222.41 |
| 0531933 | 10/1976 | U.S.S.R. | 248/221.11 |
| 0709055 | 1/1980 | U.S.S.R. | 248/297.31 |
| 3019642 | 10/1993 | WIPO | 248/222.41 |

OTHER PUBLICATIONS

Rixen et al (5,474,270), Dec. 1995.

*Primary Examiner*—Daniel P. Stodola
*Assistant Examiner*—Matthew A. Kaness

[57] ABSTRACT

An infant seat support apparatus including a folding base member. A pair of support bolts extend through the folding base member on opposing ends thereof whereby end portions of the support bolts are separated from the folding base member. An adjustable support rack is adapted for receipt of the end portions of the pair of support bolts therein for slidable positioning therein whereby a baby carrier can be positionable upon the adjustable support rack and the folding base member.

1 Claim, 3 Drawing Sheets

INFANT SEAT SUPPORT WITH A RESTING SURFACE HAVING AN ADJUSTABLE HEIGHT

BACKGROUND OF THE INVENTION

1. Field of the Invention

The present invention relates to an infant seat support apparatus and more particularly pertains to supporting an infant seat support in an elevated position with an infant seat support apparatus.

2. Description of the Prior Art

The use of collapsible infant seat is known in the prior art. More specifically, collapsible infant seat heretofore devised and utilized for the purpose of supporting an infant are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,415,456 to Hart et al. discloses a collapsible baby chair apparatus.

U.S. Pat. No. 5,269,587 to Cunningham et al. discloses a compact portable collapsible infant seat.

U.S. Pat. No. Des. 340,140 to Cunningham et al. discloses the ornamental design for a portable and collapsible infant seat.

U.S. Pat. No. 4,181,356 to Fleischer discloses folding baby carriers.

U.S. Pat. No. 5,368,318 to Rehrig discloses a collapsible child seat assembly for cart.

U.S. Pat. No. 5,207,478 to Freese et al. discloses a collapsible infant seat.

While these devices fulfill their respective, particular objective and requirements, the aforementioned patents do not describe an infant seat support apparatus for supporting an infant seat support in an elevated position.

In this respect, the infant seat support apparatus according to the present invention substantially departs from the conventional concepts and designs of the prior art, and in doing so provides an apparatus primarily developed for the purpose of supporting an infant seat support in an elevated position.

Therefore, it can be appreciated that there exists a continuing need for new and improved infant seat support apparatus which can be used for supporting an infant seat support in an elevated position. In this regard, the present invention substantially fulfills this need.

SUMMARY OF THE INVENTION

In the view of the foregoing disadvantages inherent in the known types of collapsible infant seat now present in the prior art, the present invention provides an improved infant seat support apparatus. As such, the general purpose of the present invention, which will be described subsequently in greater detail, is to provide a new and improved infant seat support apparatus and method which has all the advantages of the prior art and none of the disadvantages.

To attain this, the present invention essentially comprises a folding base member comprised of a tubular forward support and a tubular rearward support. The tubular forward support has an upper cross member, a lower cross member, and a pair of side members coupled therebetween on opposing ends of the upper and lower cross members. The rearward support has an upper cross member, a lower cross member, and a pair of side members coupled therebetween on opposing ends of the upper and lower cross members thereof. The upper cross member of the rearward support has a support bar integral therewith. The rearward support has a serrated gripping element disposed on a rear surface thereof. The rearward support is positioned within the forward support with the pair of side members of the rearward support pivotally coupled with the pair of side members of the forward support. A pair of side support straps extend between the pair of side members of the rearward support and the forward support. The lower cross members of the forward support and rearward support have a non-slip surface disposed thereon. A pair of support bolts extend through the support bar and through the upper cross member of the rearward support on opposing ends thereof whereby end portions of the support bolts are separated from the support bar. The device includes an adjustable support rack comprised of a wide upper support member and an elongated narrow lower support member. A rear surface of the narrow lower support member has a serrated gripping element disposed thereon. The narrow support member has a plurality of vertically disposed inverted L-shaped openings on opposing ends thereof. The L-shaped openings have lower free ends adapted for receipt of the end portions of the pair of support bolts therein for slidable positioning within upper free ends of the L-shaped openings for locked engagement therewith whereby a baby carrier can be positionable upon the upper support member of the adjustable support rack and the upper cross member of the forward support of the folding base member.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved infant seat support apparatus which has all the advantages of the prior art collapsible infant seat and none of the disadvantages.

It is another object of the present invention to provide a new and improved infant seat support apparatus which may be easily and efficiently manufactured and marketed.

It is a further object of the present invention to provide a new and improved infant seat support apparatus which is of durable and reliable construction.

An even further object of the present invention is to provide a new and improved infant seat support apparatus which is susceptible of a low cost of manufacture with regard to both materials and labor, and which accordingly is then susceptible of low prices of sale to the consuming public, thereby making such an infant seat support apparatus economically available to the buying public.

Still yet another object of the present invention is to provide a new and improved infant seat support apparatus which provides in the apparatuses and methods of the prior art some of the advantages thereof, while simultaneously overcoming some of the disadvantages normally associated therewith.

Even still another object of the present invention is to provide a new and improved infant seat support apparatus for supporting an infant seat support in an elevated position.

Lastly, it is an object of the present invention to provide a new and improved infant seat support apparatus including a folding base member. A pair of support bolts extend through the folding base member on opposing ends thereof whereby end portions of the support bolts are separated from the folding base member. An adjustable support rack is adapted for receipt of the end portions of the pair of support bolts therein for slidable positioning therein whereby a baby carrier can be positionable upon the adjustable support rack and the folding base member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
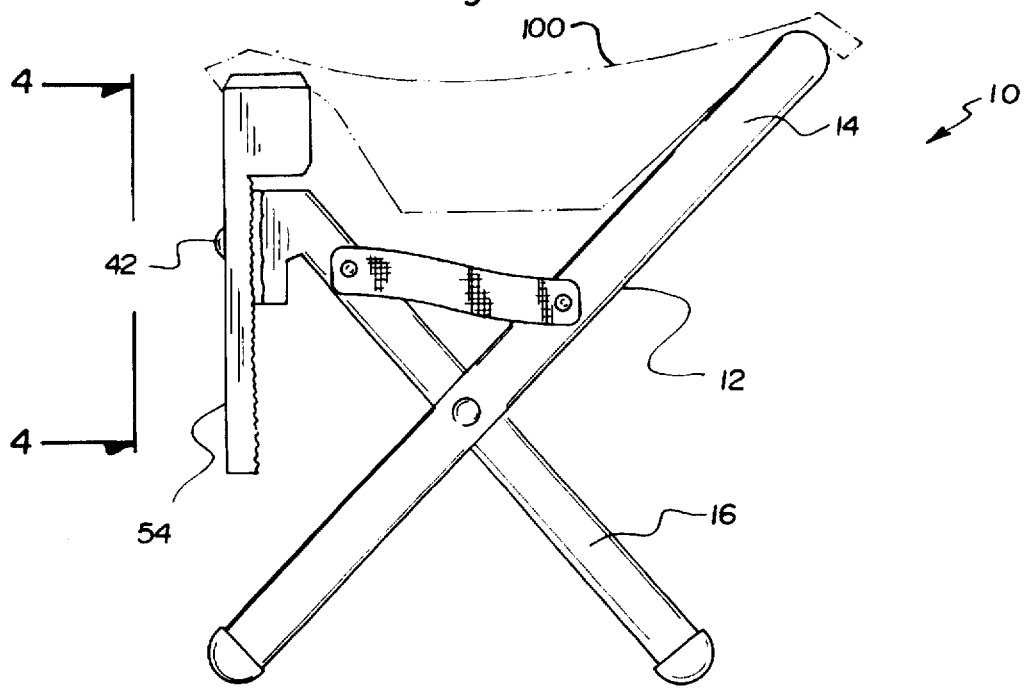
FIG. 1 is a side elevation view of the preferred embodiment of the infant seat support apparatus constructed in accordance with the principles of the present invention.
Figure 2:
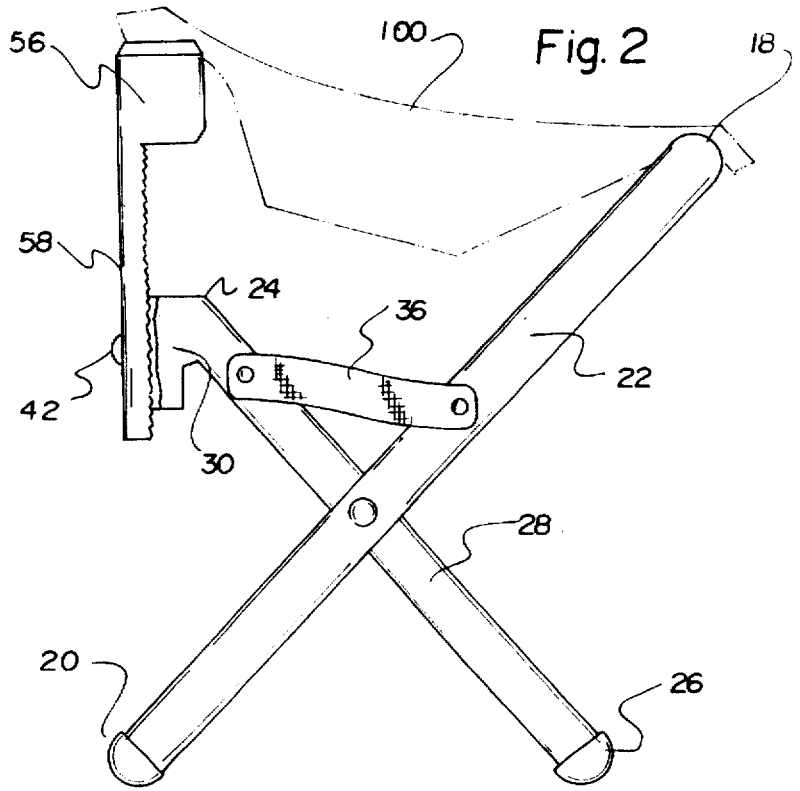
FIG. 2 is a side elevation view of the present invention illustrated in a raised orientation.
Figure 3:
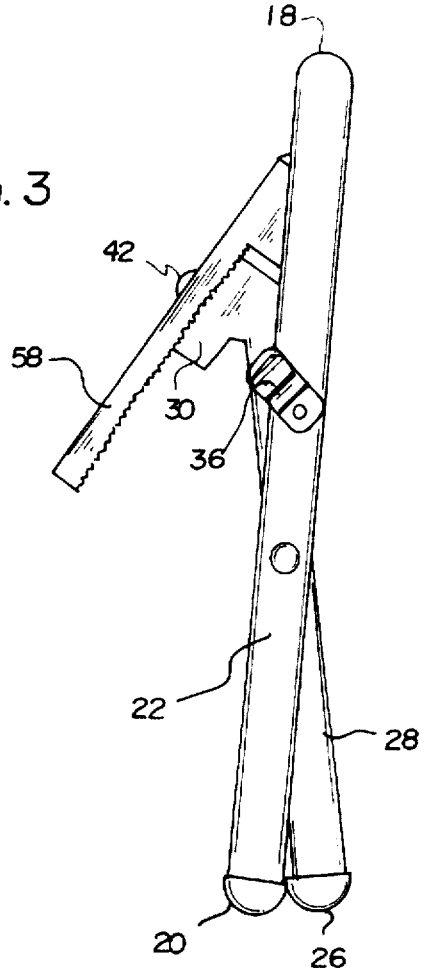
FIG. 3 is a side view of the present invention in a folded orientation.
Figure 4:
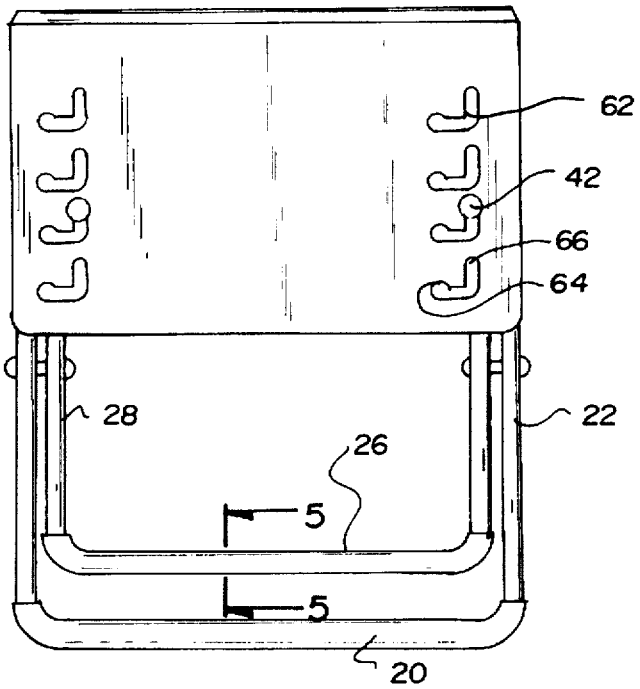
FIG. 4 is a rear elevation view of the present invention taken along line 4—4 of FIG. 1.
Figure 5:
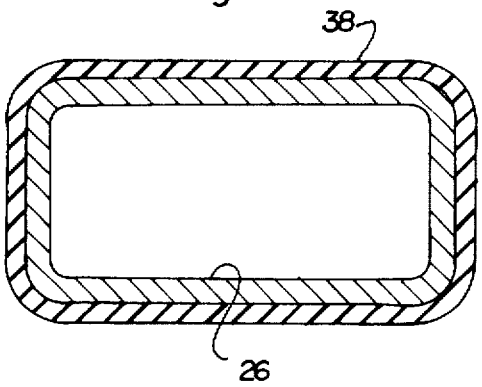
FIG. 5 is a cross-sectional view as taken along line 5—5 of FIG. 4.
Figure 6:
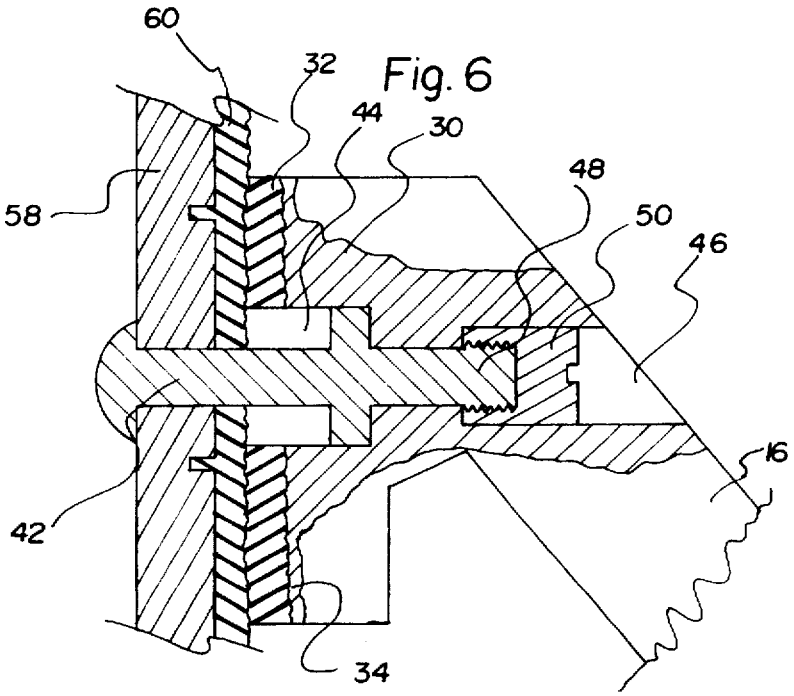
FIG. 6 is a cross-sectional side view of the adjustable support rack coupled with the support bar of the tubular rearward support.

With reference now to the drawings, and in particular, to FIGS. 1–6 thereof, the preferred embodiment of the new and improved infant seat support apparatus embodying the principles and concepts of the present invention and generally designated by the reference number 10 will be described.

Specifically, it will be noted in the various Figures that the device relates to a new and improved infant seat support apparatus for supporting an infant seat support in an elevated position. In its broadest context, the device consists of a folding base member, a pair of support bolts, and an adjustable support rack. Such components are individually configured and correlated with respect to each other so as to attain the desired objective.

The device 10 includes a folding base member 12 comprised of a tubular forward support 14 and a tubular rearward support 16. The forward support 14 and the rearward support are arranged in a generally rectangular configuration. The tubular forward support 14 has an upper cross member 18, a lower cross member 20, and a pair of side members 22 coupled therebetween on opposing ends of the upper 18 and lower cross members 20. The rearward support 16 has an upper cross member 24, a lower cross member 26, and a pair of side members 28 coupled therebetween on opposing ends of the upper 24 and lower cross members 26 thereof. The upper cross member 24 of the rearward support 16 has a support bar 30 integral therewith. The support bar 30 has a serrated gripping element 32 disposed on a rear surface 34 thereof. The length of the side members 22 of the forward support 14 have a length greater than about one and a half times a length of the side members 28 of the rearward support 16. The forward support 14 has a width greater than a width of the rearward support 16 whereby the rearward support 16 is positioned within the forward support 14 with the pair of side members 28 of the rearward support 16 pivotally coupled with the pair of side members 22 of the forward support 14. A pair of side support straps 36 extend between the pair of side members 28,22 of the rearward support 16 and the forward support 14. The pair of side support straps 36 prevent the folding base member 12 from pivoting beyond a useful point. The lower cross members 20,26 of the forward support 14 and rearward support 26 have a non-slip surface 38 disposed thereon. The non-slip surface 38 prevents the device 10 from an unnecessary sliding along a floor.

A pair of support bolts 42 extend through the support bar and through the upper cross member 24 of the rearward support 16 on opposing ends thereof whereby end portions of the support bolts 42 are separated from the support bar. The bolts 42 extend into and through a recess 44 within the support bar. The bolts 42 further extend through the upper cross member 24 and terminate in a recess 46 therein. A threaded end 48 is engaged within the recess 46 by a nut 50.

Lastly, the device 10 includes an adjustable support rack 54 comprised of a wide upper support member 56 and an elongated narrow lower support member 58. A rear surface of the narrow lower support member 58 has a serrated gripping element 60 disposed thereon. The narrow support member 58 has a plurality of vertically disposed inverted L-shaped openings 62 on opposing ends thereof. The L-shaped openings 62 have lower free ends 64 adapted for receipt of the end portions of the pair of support bolts 42 therein for slidable positioning within upper free ends 66 of the L-shaped openings 62 for locked engagement therewith. Once the end portions of the pair of support bolts 42 are positioned within the upper free ends 66, the nuts 50 can be tightened on the bolts 42. The serrated gripping element 60 corresponds with the serrated gripping element 32 of the support bar 30 to provide added support to the device 10 whereby a baby carrier 100 can be positionable upon the upper support member 56 of the adjustable support rack 54 and the upper cross member 18 of the forward support 14 of the folding base member 12.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An infant seat support apparatus for supporting an infant seat support in an elevated position comprising, in combination:

a folding base member comprised of a tubular forward support and a tubular rearward support, the tubular forward support having an upper cross member, a lower cross member, and a pair of side members coupled therebetween on opposing ends of the upper and lower cross members, the rearward support having an upper cross member, a lower cross member, and a pair of side members coupled therebetween on opposing ends of the upper and lower cross members thereof, the upper cross member of the rearward support having a support bar integral therewith, the support bar having a serrated gripping element disposed on a rear surface thereof, the rearward support positioned within an inner boundary of the forward support with the pair of side members of the rearward support pivotally coupled with the pair of side members of the forward support, a pair of side support straps extend between the pair of side members of the rearward support and the forward support, the lower cross members of the forward support and rearward support having a non-slip surface disposed thereon;

a pair of support bolts extending through the support bar and through the upper cross member of the rearward support on opposing ends thereof with end portions of the support bolts extending outwardly from the support bar;

an adjustable support rack comprised of a wide upper support member and an elongated narrow lower support member, a rear surface of the narrow lower support member having a serrated gripping element disposed thereon, the narrow lower support member having a plurality of vertically disposed inverted L-shaped openings on opposing ends thereof, the L-shaped openings having lower free ends for receiving the end portions of the pair of support bolts therein for slidable positioning within upper free ends of the L-shaped openings for locked engagement therewith; and a baby carrier removably positionable upon the upper support member of the adjustable support rack and the upper cross member of the forward support of the folding base member, the baby carrier having outwardly extending end tabs for coupling with the upper support member and the upper cross member.

* * * * *